US009879190B2

(12) United States Patent
Wang et al.

(10) Patent No.: US 9,879,190 B2
(45) Date of Patent: Jan. 30, 2018

(54) INTERNAL COMBUSTION HEATING DEVICE OF COAL PYROLYZING FURNACE

(71) Applicant: SHANXI XINLI ENERGY TECHNOLOGY CO., LTD, Taiyuan, Shanxi (CN)

(72) Inventors: Xinmin Wang, Shanxi (CN); Wenbu Wang, Shanxi (CN)

(73) Assignee: SHANXI XINLI ENERGY TECHNOLOGY CO., LTD., Taiyuan, Shanxi (CN)

( * ) Notice: Subject to any disclaimer, the term of this patent is extended or adjusted under 35 U.S.C. 154(b) by 422 days.

(21) Appl. No.: 14/419,936

(22) PCT Filed: Aug. 5, 2013

(86) PCT No.: PCT/CN2013/080817

§ 371 (c)(1),
(2) Date: Feb. 6, 2015

(87) PCT Pub. No.: WO2014/023208

PCT Pub. Date: Feb. 13, 2014

(65) Prior Publication Data

US 2015/0275107 A1 Oct. 1, 2015

(30) Foreign Application Priority Data

Aug. 6, 2012 (CN) ..... 2012 1 0278088

(51) Int. Cl.

| | |
|---|---|
| ***C10J 3/20*** | (2006.01) |
| ***C10B 53/04*** | (2006.01) |
| ***C10B 57/00*** | (2006.01) |
| ***F23C 9/06*** | (2006.01) |
| ***F23C 6/04*** | (2006.01) |
| ***F23B 30/00*** | (2006.01) |

(Continued)

(52) U.S. Cl.

CPC ..... *C10J 3/20* (2013.01); *C10B 3/00* (2013.01); *C10B 3/02* (2013.01); *C10B 21/10* (2013.01); *C10B 31/02* (2013.01); *C10B 33/12* (2013.01); *C10B 39/02* (2013.01); *C10B 53/04* (2013.01); *C10B 57/005* (2013.01); *F23B 5/04* (2013.01); *F23C 6/04* (2013.01); *F23C 9/06* (2013.01)

(58) Field of Classification Search

CPC ..... C10J 3/20; C10B 53/04; C10B 57/005; C10B 3/00; C10B 3/02; C10B 21/10; C10B 31/02; C10B 33/12; C10B 39/02; F23C 9/06; F23C 6/04; F23B 5/04

See application file for complete search history.

(56) References Cited

U.S. PATENT DOCUMENTS 4,997,527 A * 3/1991 Kress ..... C10B 39/02 201/27

* cited by examiner

*Primary Examiner* — David J Laux

(57) ABSTRACT

An internal combustion heating device of a coal pyrolyzing furnace includes a coke quenching exhaust heater and at least one set of a third gas heater and a fourth gas heater with equal structures and associated with each other; wherein the coke quenching exhaust heater comprises an internal flame path, a first air supply tube, a second air supply tube, a central annular wall and a central path, wherein an internal flame path is divided into at least one set of an internal main flame path and an internal sub flame path, the central annular wall inside the internal loop wall of the carbonizing room and at least one the internal flame path isolating wall; the internal sub flame path is divided into an upper section, a middle section and a lower section.

4 Claims, 10 Drawing Sheets

(51) Int. Cl.

| | |
|---|---|
| ***C10B 33/12*** | (2006.01) |
| ***C10B 21/10*** | (2006.01) |
| ***C10B 3/02*** | (2006.01) |
| ***C10B 3/00*** | (2006.01) |
| ***C10B 39/02*** | (2006.01) |
| ***C10B 31/02*** | (2006.01) |

C–C

INTERNAL COMBUSTION HEATING DEVICE OF COAL PYROLYZING FURNACE

CROSS REFERENCE OF RELATED APPLICATION

This is a U.S. National Stage under 35 U.S.C. 371 of the International Application PCT/CN2013/080817, filed Aug. 5, 2013, which claims priority under 35 U.S.C. 119(a-d) to CN 201210278088.4, filed Aug. 6, 2012.

BACKGROUND OF THE PRESENT INVENTION

Field of Invention

The present invention relates to a gas combustion heating device, and more particularly to a device which utilizes gas generated by dry quenching and pyrolyzing of a coal pyrolyzing furnace for burning and heating.

Description of Related Arts

Conventionally, coal pyrolyzing furnaces (coke ovens) on the market usually utilize intermittent coking, wherein the proportion of inputting coal, dehydration, coal feeding, preheating, carbonization, coke modification, dry quenching, etc. are relatively independent, which results in discontinuous production and low productivity. In addition, raw gas produced during coal pyrolyzing comprises many useful ingredients, such as $H_2S$, HCL acid gases, $NH_3$ alkaline gas, tar, benzene, naphthalene, and absorber oil. There is no complete technique for exporting, recovering, purifying and utilizing the raw gas.

This prompted the present inventors to explore and create a complete set of techniques for continuous coking as well as exporting, recovering, purifying and recycling the raw gas.

SUMMARY OF THE PRESENT INVENTION

An object of the present invention is to provide an internal combustion heating device of a coal pyrolyzing furnace, wherein the device utilizes not only combustible high-temperature exhaust generated by dry quenching of the coal pycrolyzing furnace, but also clean coal gas obtained by purifying and recycling raw gas generated by coal pyrolsis of the coal pycrolyzing furnace, for burning and heating.

Accordingly, in order to accomplish the above object, the present invention provides:

an internal combustion heating device of a coal pyrolyzing furnace, arranged in an internal loop wall of a carbonizing room above a flame path bow, comprising: a coke quenching exhaust heater and at least one set of a third gas heater and a fourth gas heater with equal structures and associated with each other; wherein the coke quenching exhaust heater comprises an internal flame path, an air supplement tube, a first air supply tube, a second air supply tube, an air supply annular path, a central annular wall, an internal flame path isolating wall and a central path, wherein the internal flame path is divided into at least one set of an internal main flame path and an internal sub flame path in parallel by the internal loop wall of the carbonizing room, the central annular wall inside the internal loop wall of the carbonizing room and at least one internal flame path isolating wall; an upper plugging separating plate and a lower plugging separating plate are provided in the internal sub flame path and divide the internal sub flame path into an upper section, a middle section and a lower section, which forms an upper internal sub flame path section, a middle internal sub flame path section and a lower inter sub flame path section; a waste gas communicating hole is drilled on a flame path isolating wall between the upper internal sub flame path section and the internal main flame path, a hot waste gas outputting path is provided at a top portion of the upper internal sub flame path section and the internal main flame path, and a flame path communicating hole is drilled on a flame path isolating wall between the lower internal sub flame path section and the internal main flame path; the central path is formed by the central annular wall, a path separating plate is provided at a part of the central path which is abreast of the upper plugging separating plate for dividing the central path into an upper portion and a lower portion, in such a manner that the upper portion forms a buffer zone and the lower portion forms a high-temperature combustible exhaust inputting path; a waste gas inputting hole is drilled on an upper portion of the central annular wall and passes through the buffer zone, the internal main flame path and the upper internal sub flame path section; a combustible waste gas inputting hole is drilled at a lower portion of the central annular wall and passes through the high-temperature combustible exhaust inputting path, the internal main flame path and the lower internal sub flame path section; the air supply annular path is provided on an external wall of a furnace body and communicates with the air supplement tube as well as the first air supply tube and the second air supply tube; the first air supply tube and the second air supply tube pass below a strip bow of the flame path bow and extend upwards for being inside the flame path isolating wall between the internal main flame path and the internal sub flame path; an opening of the first air supply tube is arranged under the lower plugging separating plate and respectively connected to the internal main flame path and the lower internal sub flame path section; an opening of the second air supply tube is connected to the internal main flame path; the middle internal sub flame path section forms a relative-closed independent gas combustor; adjacent middle internal sub flame path sections communicate with each other through a combustor path and form a cooperating set, the combustor path is under the upper plugging separating plate and passes through the internal main flame path between the adjacent middle internal sub flame path sections; the third gas heater comprises a third combustor, a third coal gas inputting sub-tube, a third heat storing chamber, a third heat storing body, a third air inputting sub-tube and a third exhaust outputting sub-tube, wherein the third combustor is formed by the middle internal sub flame path section, the third coal gas inputting sub-tube passes below the strip bow of the flame path bow and extends upwards for being connected to the third combustor by passing through the flame path isolating wall which is formed by the middle internal sub flame path section; the third heat storing chamber is arranged on the furnace body under the strip bow, and the third heat storing body is arranged inside the third heat storing chamber; a first end of the third heat storing chamber passes below the strip bow of the flame path bow through an extending path and extends upwards for being connected to a bottom of the third combustor by passing through the flame path isolating wall, a second end of the third heat storing chamber is respectively connected to the third air inputting sub-tube and the exhaust outputting sub-tube; similarly, the fourth gas heater equals to the third gas heater in structures, wherein a fourth combustor forms a cooperating set with the third combustor through the combustor path.

Preferably, the flame path communicating hole is provided close to a lower portion of the lower plugging separating plate.

Preferably, the hot waste gas outputting path is communicated with a waste gas room at an upper portion of the furnace body.

Preferably, the opening of the second air supply tube is located at a position which is level with or slightly higher than the upper plugging separating plate.

According to the present invention, the upper internal sub flame path section and the lower internal sub flame path section as well as the internal main flame path utilize the high-temperature combustible exhaust generated by dry quenching for gas refilling, burning and heating, so as to avoid directly discharging dry quenching exhaust and atmosphere pollution. The middle internal sub flame path section utilizes the clean coal gas obtained by purifying and recycling the raw gas for burning, gas refilling and heating, so as to increase an insufficient burning capacity of the high-temperature combustible exhaust, in such a manner that sufficient temperature and heat are provided for coal pyrolyzing and carbonizing. There is no need for extra heating equipment, which is eco-friendly and economic, and lowers a coking cost.

BRIEF DESCRIPTION OF THE DRAWINGS

Referring to the drawings, a preferred embodiment of the present invention is further illustrated in detail.

FIG. 5-1 is a sketch view of pipeline connection of the gas reversing device and a gas heater of the present invention.

DETAILED DESCRIPTION OF THE PREFERRED EMBODIMENT

A preferred embodiment of an internal combustion heating device of a coal pyrolyzing furnace of the present invention is described in detail in Section I, Part IV.

Part I: Proportion and Preparation of Inputting Coal

Five different kinds of coal are selected, which are gas coal, fat coal, coking coal, one-third coking coal and lean coal. The five different kinds of coal are mixed and then screened and crashed for forming the inputting coal. Of course, other proportions are also adaptable to the coal pyrolyzing furnace of the present invention. Therefore, inputting coal powder of the coal pyrolyzing furnace of the present invention is not limited.

Part II: Dehydration of Inputting Coal

By pre-dehydrating the inputting coal of the coal pyrolyzing furnace through a dehydration device, energy is saved.

Part III: Feeding, Pre-Heating, Regulating and Cooling of Inputting Coal

After transporting, a temperature of dehydrated inputting coal usually drops to a room temperature, or even lower. Therefore, the inputting coal is pre-heated, regulated and cooled before entering a carbonizing room.

Section I: Feeding the Inputting Coal

The dehydrated inputting coal is inputted through a feeding device.

Section II: Pre-Heating the Inputting Coal

A pre-heating device is provided under the feeding device and at a top of the coal pyrolyzing furnace. The pre-heating device pre-heats the inputting coal which is cooled during transporting.

Section III: Regulation of Pre-Heated Inputting Coal

An inputting coal regulating room is arranged at the top of a furnace body and below the pre-heating device, for adjusting an amount of the inputting coal fed in the carbonizing room of the coal pyrolyzing furnace.

Part IV: Pyrolysis of Inputting Coal (Carbonizing Heating, Coke Modification and Dry Quenching)

Section I: Pyrolyzing, Carbonizing and Heating of Inputting Coal

Figure 2:
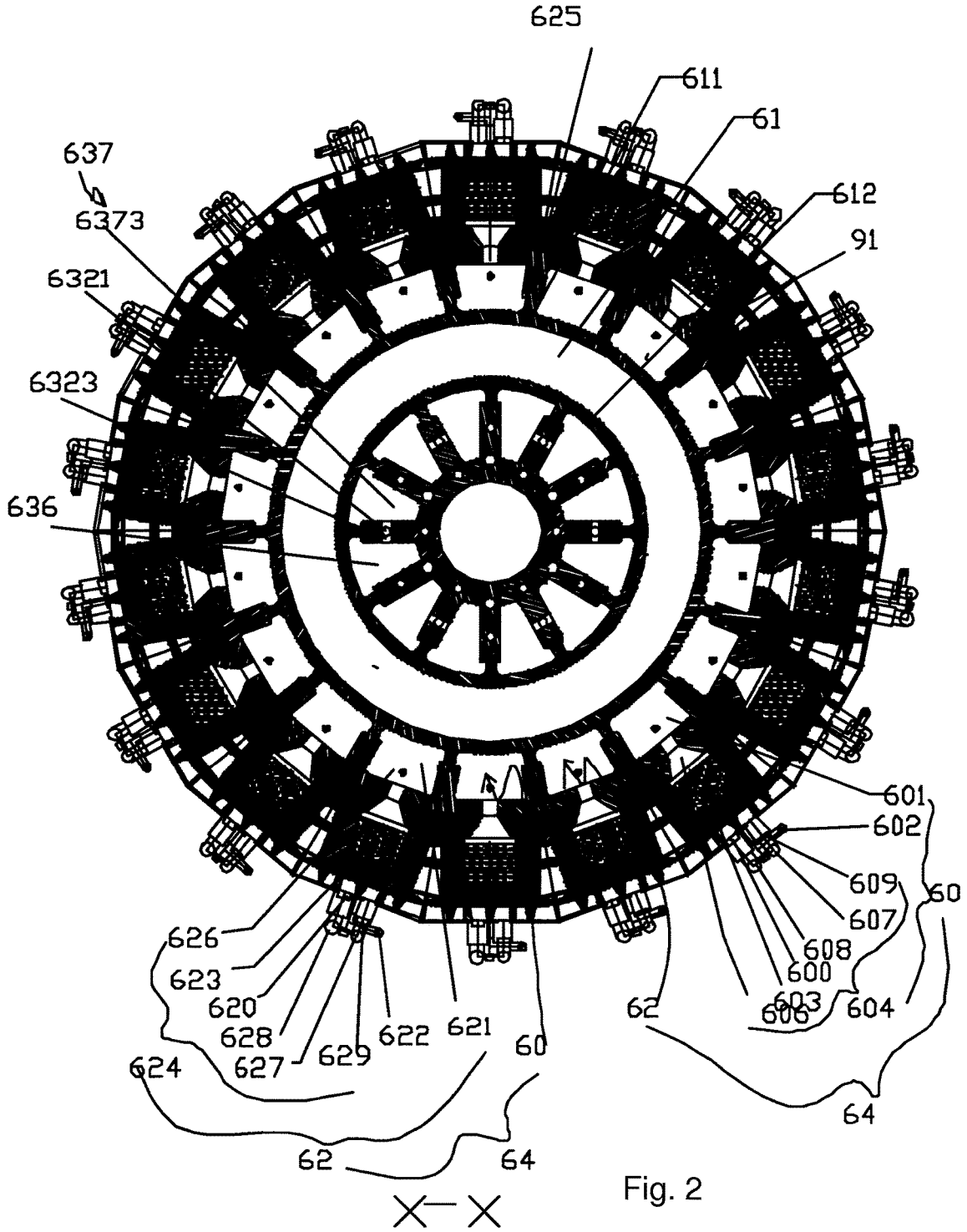
FIG. 2 is a sectional view of x-x in FIG. 1.
Figure 15:
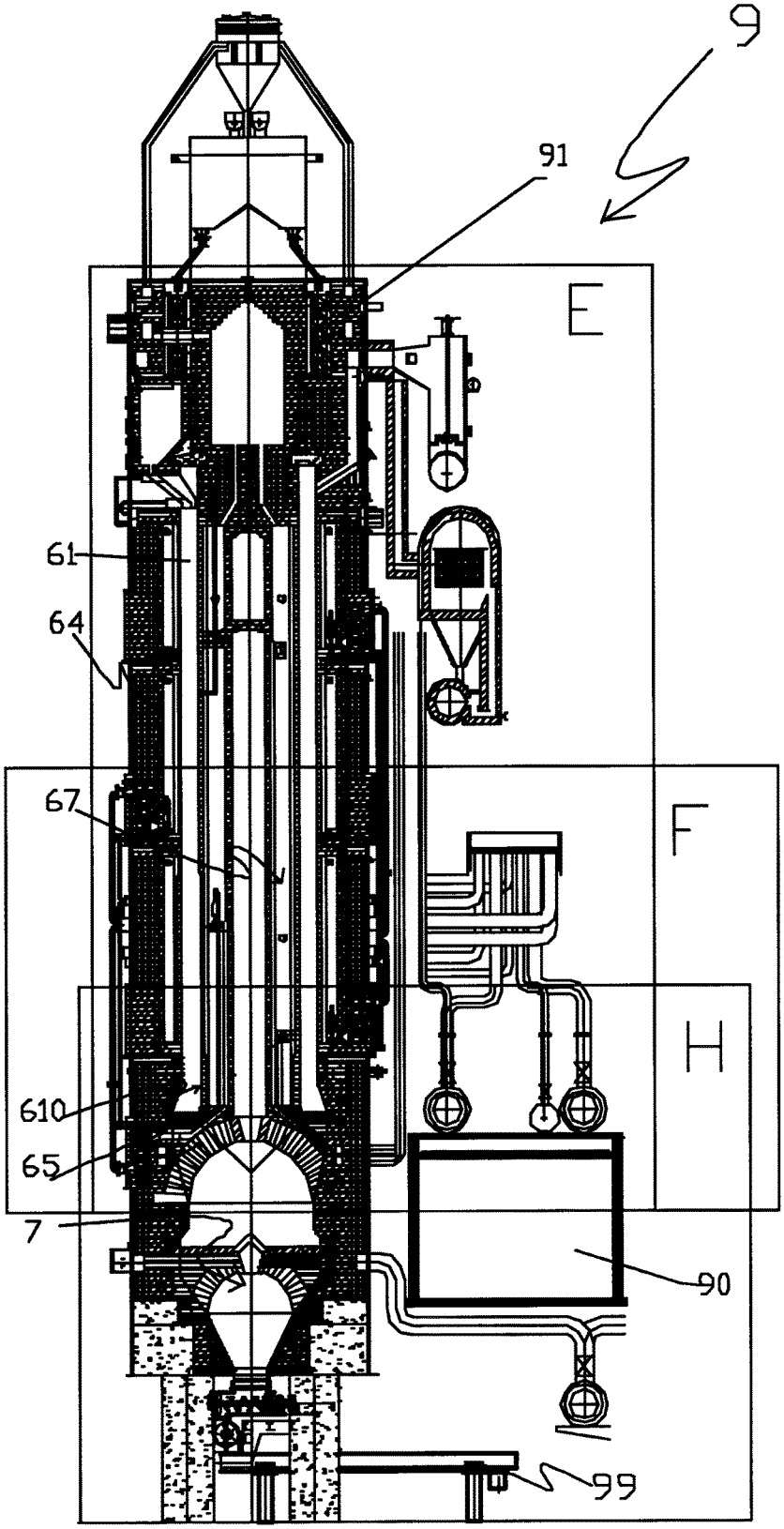
FIG. 15 is an overall sketch view of the coal pyrolyzing furnace of the present invention.

Referring to FIG. 15, a coal pyrolyzing and carbonizing device 6 is arranged in a center of a furnace body 91, which comprises: a carbonizing room 61, an external gas heating device 64, an internal burning heating device 67 and a flame path bow 65. Referring to FIG. 2, the carbonizing room 61 is in a loop chamber, the loop chamber is formed by an internal loop wall 612 and an external loop wall 611 made of fire-resistant and heat-conductive materials; the external gas heating device 64 is around an external circle of the external loop wall 611 of the carbonizing room, wherein the external gas heating device 64 comprises a plurality of equal sets (9 sets according to the preferred embodiment) of a first gas heater 62, a second gas heater 60 and a gas reversing device 66. In addition, referring to FIG. 15, because of a high temperature of the carbonizing room 61, the external gas heating device 64 heats with an upper heating section, a middle heating section and a lower heating section, and each heating section comprises 9 sets of the first gas heating devices 62 and the second gas heaters 60 with same structures.

Figure 6:
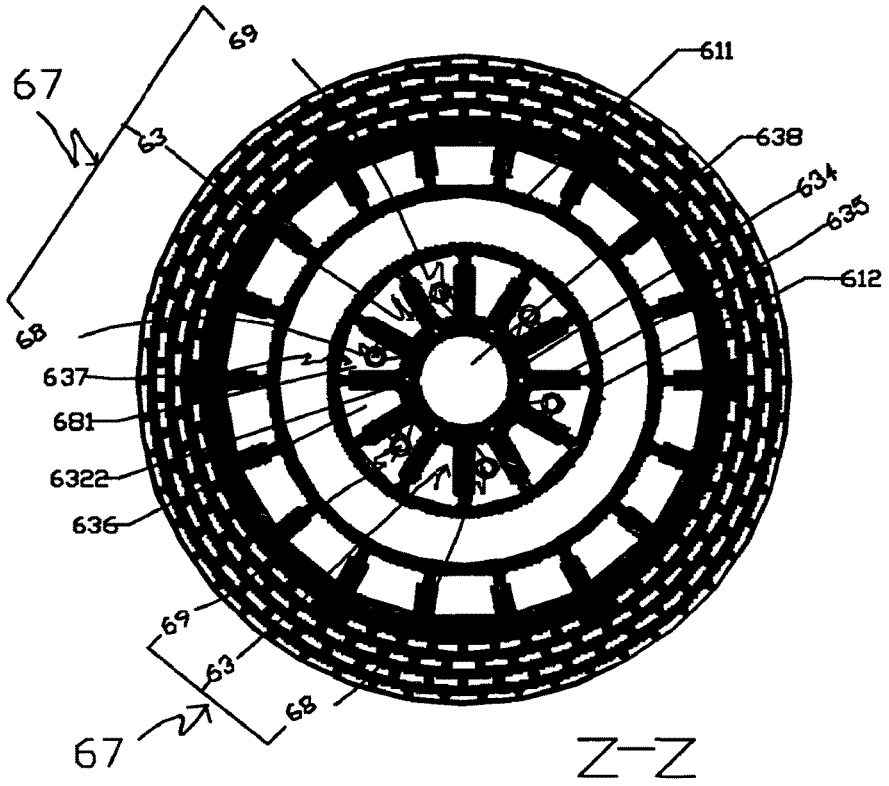
FIG. 6 is a sectional view of z-z in FIG. 11.

Referring to FIG. 6, the internal burning heating device 67 is inside the internal loop wall 612 of the carbonizing room 61, wherein the internal burning heating device 67 comprises a plurality of equal sets (3 sets according to the preferred embodiment) of a third gas heater 68, a fourth gas heater 69 and a coke quenching exhaust heater 63.

Figure 1:
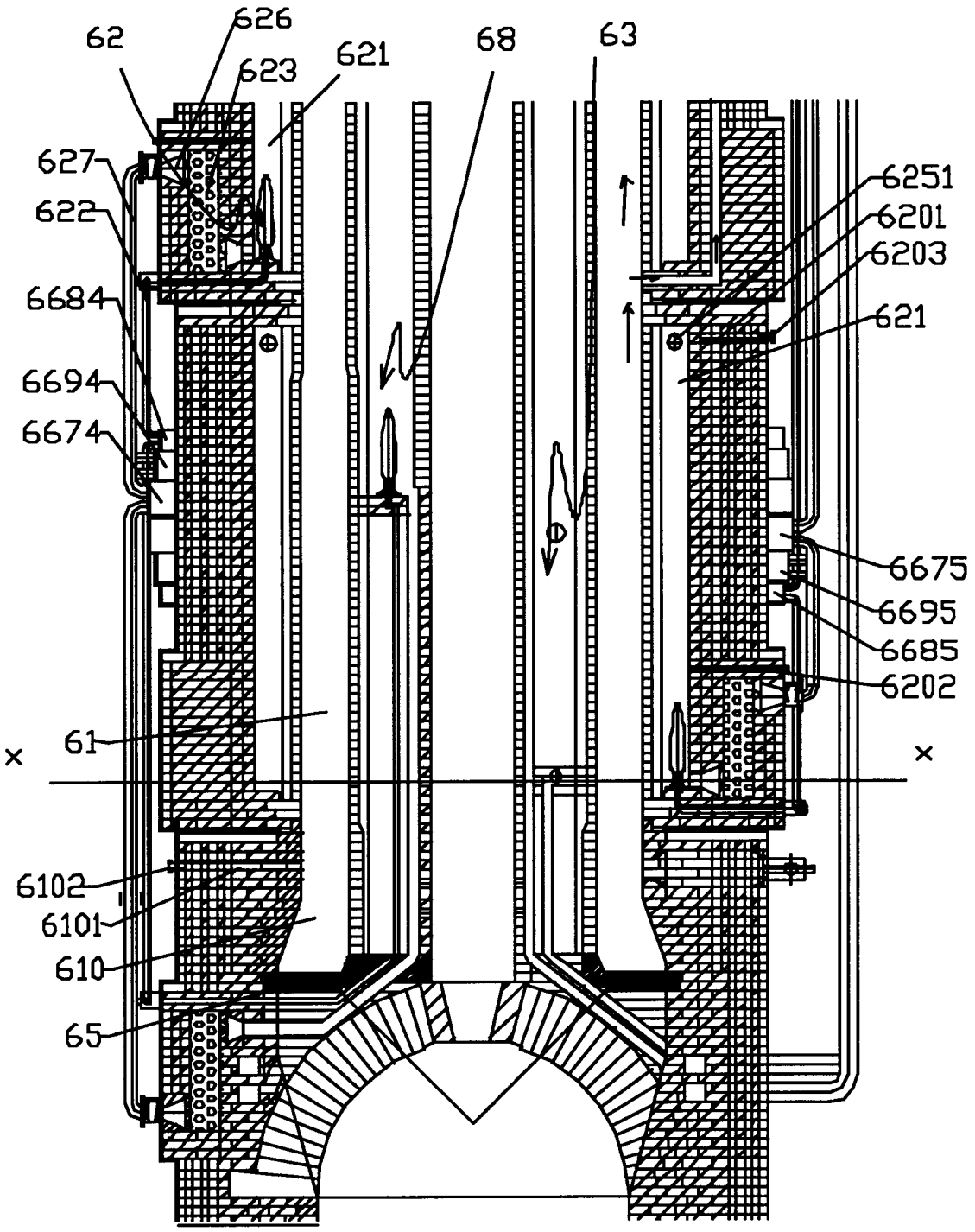
FIG. 1 is an enlarged view of F in FIG. 15.

Referring to FIG. 1 and FIG. 2, the first gas heater 62 comprises a first combustor 621, a first coal gas inputting sub-tube 622 and a first storing heat exchanger 624.

Referring to FIG. 2, the first combustor 621 has a relative-closed coal gas burning flame path formed by an external wall of the furnace body 91 which is made of fire-resistant materials, the external loop wall 611 of the carbonizing room made of fire-resistant and heat-conductive materials, and an external flame path isolating wall 625. Referring to FIG. 1, the first coal gas inputting sub-tube 622 passes through the external wall of the furnace body 91 and reaches the first combustor 621.

Referring to FIG. 1 and FIG. 2, the first storing heat exchanger 624 comprises a first heat storing chamber 626, a first heat storing body 623, a first air inputting sub-tube 627 and a first exhaust outputting sub-tube 628, wherein the first heat storing chamber 626 is inside the external wall of the furnace body 91, the first heat storing body 623 is inside the first heat storing chamber 626, a first end of the first heat storing chamber 626 communicates with the bottom of the first combustor 621, a second end of the first heat storing chamber 626 is connected to the first air inputting sub-tube 627 and the first exhaust outputting sub-tube 628.

Figure 3:
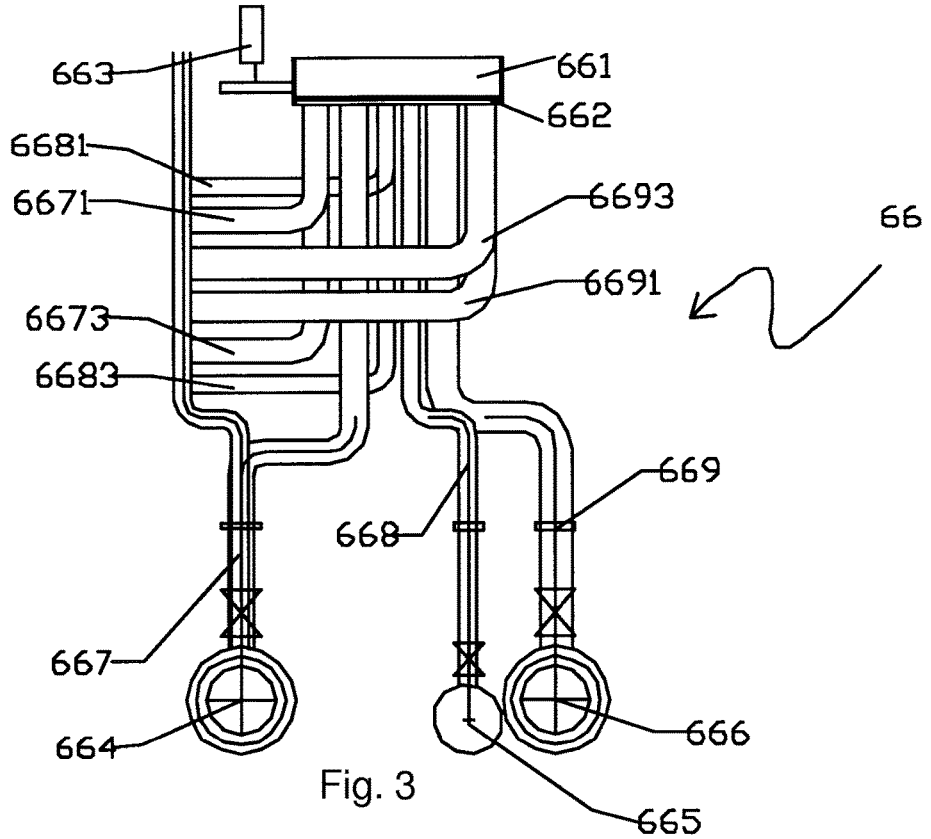
FIG. 3 is a sketch view of a gas reversing device of the present invention.
Figure 4:
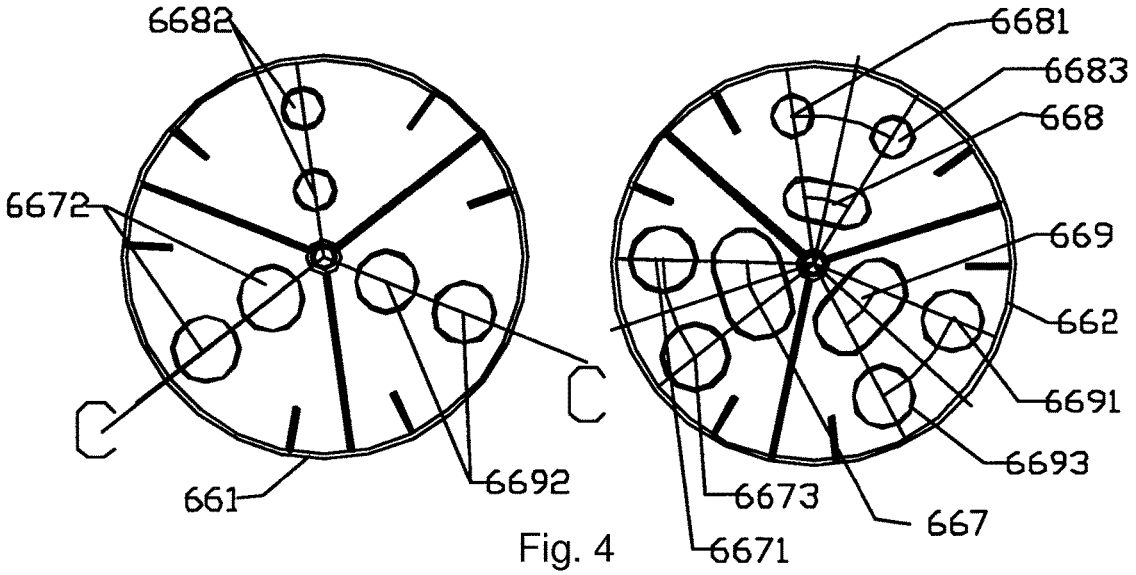
FIG. 4 is a sketch view of an upper disk and a lower disk of the gas reversing device of the present invention.

Referring to FIGS. 2-4, a first one-way air valve 629 is arranged between the first air inputting sub-tube 627 and the first heat storing chamber 626, wherein the first one-way air valve enables air to enter the first combustor 621 from the first air inputting sub-tube 627 and the first heat storing chamber 626; a first one-way exhaust valve 620 is arranged between the first exhaust outputting sub-tube 628 and the first heat storing chamber 626, wherein the first one-way exhaust valve 620 enables waste gas produced by coal gas combustion to flow from the first combustor 621, pass through the first heat storing chamber 626, and finally be outputted from the first exhaust outputting sub-tube 628 (Of course, by utilizing the following gas reversing device 66, wherein an air main tube 667 communicates with a first air sub-tube 6671, and the air main-tube 667 is cut off from a second air sub-tube 6673; while an exhaust main-tube 669 is cut off from a first exhaust sub-tube 6691, and the exhaust main-tube 669 communicates with a second exhaust sub-tube 6693, functions of the first one-way air valve 629 and the first one-way exhaust valve 620 are able to be substituted).

Similarly, referring to FIG. 2, the second gas heater 60 comprises a second combustor 601, a second coal gas inputting sub-tube 602 and a second storing heat exchanger 604. The second combustor 601 has a relative-closed coal gas burning flame path formed by the external wall of the furnace body 91 which is made of fire-resistant materials, the external loop wall 611 of the carbonizing room made of fire-resistant and heat-conductive materials, and the external flame path isolating wall 625. The second coal gas inputting sub-tube 602 passes through the external wall of the furnace body 91 and reaches the second combustor 601.

Referring to FIG. 2 and FIG. 3, the second storing heat exchanger 604 comprises a second heat storing chamber 606, a second heat storing body 603, a second air inputting sub-tube 607 and a second exhaust outputting sub-tube 608, wherein the second heat storing chamber 606 is inside the external wall of the furnace body 91, the second heat storing body 603 is inside the second heat storing chamber 606; a first end of the second heat storing chamber 606 communicates with a bottom of the second combustor 601, a second end of the second heat storing chamber 606 is connected to the second air inputting sub-tube 607 and the second exhaust outputting sub-tube 608. A second one-way air valve 609 is arranged between the second air inputting sub-tube 607 and the second heat storing chamber 606, wherein the second one-way air valve 609 enables air to enter the second combustor 601 from the second air inputting sub-tube 607 and the second heat storing chamber 606; a second one-way exhaust valve 600 is arranged between the second exhaust outputting sub-tube 608 and the second heat storing chamber 606, wherein the second one-way exhaust valve 600 enables waste gas produced by coal gas combustion to flow from the second combustor 601, pass through the second heat storing chamber 606, and finally be outputted from the second exhaust outputting sub-tube 608 (Of course, by utilizing the following gas reversing device 66, wherein the air main tube 667 is cut off from the first air sub-tube 6671, and the air main-tube 667 communicates with the second air sub-tube 6673; while the exhaust main-tube 669 communicates with the first exhaust sub-tube 6691, and the exhaust main-tube 669 is cut off from the second exhaust sub-tube 6693, functions of the second one-way air valve 609 and the second one-way exhaust valve 600 are able to be substituted).

Referring to FIG. 1 and FIG. 2, a combustor through-hole 6251 is drilled at a top of the external flame path isolating wall 625 between the first combustor 621 and the adjacent second combustor 601. The combustor through-hole 6251 connects the first combustor 621 and the adjacent second combustor 601 for forming an associated set. According to the preferred embodiment, 18 external flame path isolating walls 625 are provided on the external gas heating device 64 for forming 9 associated burning sets; in addition, referring to FIG. 15, because of a high temperature of the carbonizing room 61, the external gas heating device 64 heats with the upper heating section, the middle heating section and the lower heating section, and each heating section comprises 9 sets of the first gas heating devices 62 and the second gas heaters 60 with same structures.

In summary, gas heating and storing heat exchanging are:

1) when burning the coal gas in the first combustor 621, clean coal gas obtained by purifying and recycling raw gas enters the first combustor 621 through the first coal gas inputting sub-tube 622, and the first one-way air valve 629 is open for enabling air to enter the first combustor 621 through the first air inputting sub-tube 627 and the first heat storing chamber 626; the first one-way exhaust valve 620 is closed; after hot exhaust generated enters the second combustor 601 through the combustor through-hole 6251, and the hot exhaust passes through the second heat storing body 603 of the second heat storing chamber 606, the second heat storing body 603 cools the hot exhaust, then the hot exhaust becomes low-temperature exhaust with a relatively low temperature and is outputted from the second exhaust outputting sub-tube 608;

2) when burning the coal gas in the second combustor 601, the clean coal gas obtained by purifying and recycling raw gas enters the second combustor 601 through the second coal gas inputting sub-tube 602, and the second one-way air valve 609 is open for enabling the air to enter the second combustor 601 through the second air inputting sub-tube 607 and the second heat storing chamber 606, wherein the air is heated by the second heat storing body 603 and becomes hot air for supporting coal gas combust in the second combustor 601; meanwhile, the second one-way exhaust valve 600 is closed; after hot exhaust generated during combust of the coal gas in the second combustor 601 enters the first combustor 621 through the combustor through-hole 6251, and the hot exhaust passes through the first heat storing body 623 in the first heat storing chamber 626, the first heat storing body 623 cools the hot exhaust, then the hot exhaust becomes low-temperature exhaust with a relatively low temperature and is outputted from the first exhaust outputting sub-tube 628; and 3) similarly, 1) and 2) are alternatively repeated.

Referring to FIG. 1, a combustor temperature observing hole 6201 and a combustor observing hole 6202 are drilled on the external wall of the furnace body 91, wherein the combustor observing hole 6202 is conducive to visually observing each combustor; a combustor thermometer 6203 is provided in the combustor temperature observing hole 6201 for detecting a temperature of the combustor, so as to assess a coal pyrolyzing process.

Figure 14:
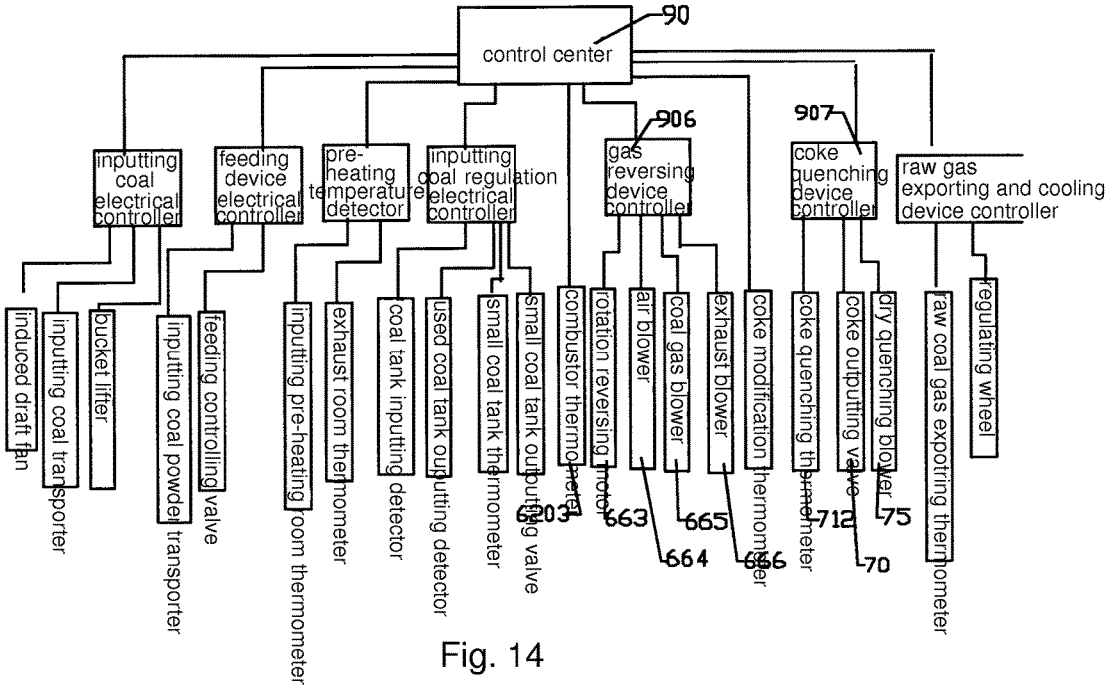
FIG. 14 is a sketch view of electrical connection of a control center of the coal pyrolyzing furnace of the present invention.

Referring to FIG. 14, the combustor thermometer 6203 is connected to a control center 90, and the control center 90 automatically collects temperature data from the combustor thermometer 6203.

Figure 5:
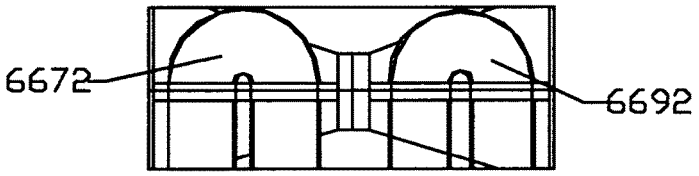
FIG. 5 is a sectional view of c-c in FIG. 14.
Figures 1, 5:
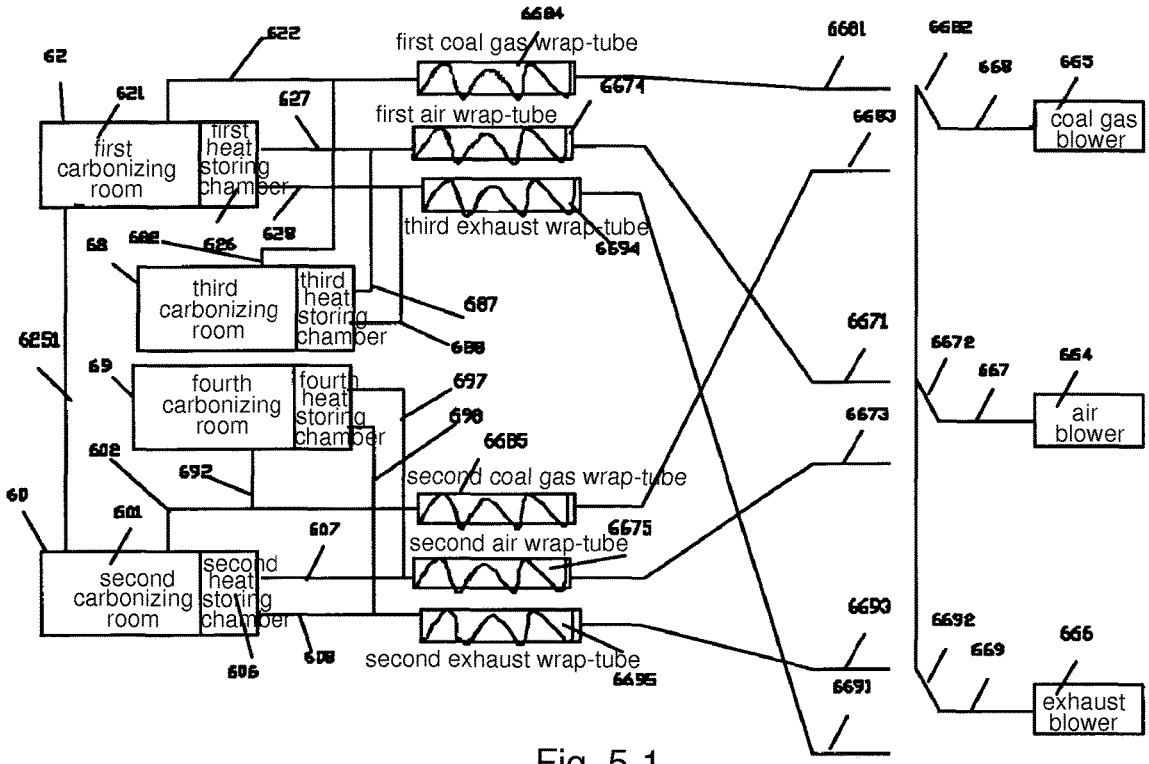

Referring to FIG. 3, FIG. 4 and FIG. 5-1, the gas reversing device 66 comprises an upper disk 661, a lower disk 662, a rotation reversing motor 663, an air blower 664, a coal gas blower 665, and an exhaust blower 666, wherein the lower disk 662 is respectively connected to an air main-tube 667, a first air sub-tube 6671, a second air sub-tube 6673, a coal gas main-tube 668, a first coal gas sub-tube 6681, a second coal gas sub-tube 6683, an exhaust main-tube 669, a second exhaust sub-tube 6693 and a first exhaust sub-tube 6691, wherein arrangement of the second exhaust sub-tube 6693 and the first exhaust sub-tube 6691 is opposite to arrangement of the first air sub-tube 6671 and said second air sub-tube 6673 as well as arrangement of the first coal gas sub-tube 6681 and the second coal gas sub-tube 6683 (as shown in FIG. 4 and FIG. 5-1).

Referring to FIG. 3, FIG. 15 and FIG. 5-1, the upper disk 661 is attached on the lower disk 662; an air communicating tube 6672, a coal gas communicating tube 6682 and an exhaust communicating tube 6692 are respectively connected to the upper disk 661; the rotating reversing motor 663 drives the upper disk 661 to rotate back and forth on the lower disk 662 for continuously connecting and disconnecting the air main-tube 667 with the first air sub-tube 6671 and the second air sub-tube 6673, continuously connecting and disconnecting the coal gas main-tube 668 with first coal gas sub-tube 6681 and the second coal gas sub-tube 6683, and continuously connecting and disconnecting the exhaust main-tube 669 with the second exhaust sub-tube 6693 and the first exhaust sub-tube 6691 (wherein switch of the first air sub-tube 6671 and the second air sub-tube 6673, and the switch of the first coal gas sub-tube 6681 and the second coal gas sub-tube 6683 are opposite).

Referring to FIG. 1 and FIG. 5-1, two sets of wrap-tubes are provided at the peripheral of the furnace body 91, comprise a first air wrap-tube 6674, a first coal gas wrap-tube 6684, a first exhaust wrap-tube 6694; a second air wrap-tube 6675, a second coal gas wrap-tube 6685 and a second exhaust wrap-tube 6695.

Referring to FIG. 5-1, the first air wrap-tube 6674 connects the first air sub-tube 6671 to the first air inputting sub-tube 627, in such a manner that a tunnel is formed with the first air sub-tube 6671, the first air wrap-tube 6674, the first air inputting sub-tube 627, the first heat storing chamber 626 and the first combustor 621; meanwhile, the first coal gas wrap-tube 6684 connects the first coal gas sub-tube 6681 to the first coal gas inputting sub-tube 622, in such a manner that a tunnel is formed with the first coal gas sub-tube 6681, the first coal gas wrap-tube 6684, the first coal gas inputting sub-tube 622 and the first combustor 621; meanwhile, the first exhaust wrap-tube 6694 connects the first exhaust sub-tube 6691 to the first exhaust outputting sub-tube 628, in such a manner that a tunnel is formed with the first exhaust sub-tube 6691, the first exhaust outputting sub-tube 628, the first heat storing chamber 626 and the first combustor 621; and similarly, the second air wrap-tube 6675 connects the second air sub-tube 6673 to the second air inputting sub-tube 607, in such a manner that a tunnel is formed with the second air sub-tube 6673, the second air wrap-tube 6675, the second air inputting sub-tube 607, the second heat storing chamber 606 and the second combustor 601; meanwhile, the second coal gas wrap-tube 6685 connects the second coal gas sub-tube 6683 to the second coal gas inputting sub-tube 602, in such a manner that a tunnel is formed with the second coal gas sub-tube 6683, the second coal gas wrap-tube 6685, the second coal gas inputting sub-tube 602 and the second combustor 601; meanwhile, the second exhaust wrap-tube 6695 connects the second exhaust sub-tube 6693 to the second exhaust outputting sub-tube 608, in such a manner that a tunnel is formed with the second exhaust sub-tube 6693, the second exhaust outputting sub-tube 608, the second heat storing chamber 606 and the second combustor 601.

In addition, referring to FIG. 14, the preferred embodiment further comprises a gas reversing controller 906 for controlling the rotation reversing motor 663, the air blower 664, the coal gas blower 665 and the exhaust blower 666. The gas reversing controller 906 is inferiorly connected to the control center 90. Of course, according to electrical control principle, the rotation reversing motor 663, the air blower 664, the coal gas blower 665 and the exhaust blower 666 may be directly controlled by the control center 90, and the gas reversing controller 906 is not a limit of the preferred embodiment.

Referring to FIG. 1, FIG. 5-1 and FIGS. 2-5, a heating method of the external gas heating device 64 comprises steps of:

(1) driving the upper disk 661 to rotate on the lower disk 662 by the rotation reversing motor 663 of the gas reversing device 66, connecting the air main-tube 667 to the first air sub-tube 6671, and cutting off the air main-tube 667 from the second air sub-tube 6673; meanwhile, connecting the coal gas main-tube 668 to the first coal gas sub-tube 6681, and cutting off the coal gas main-tube 668 from the second coal gas sub-tube 6683; meanwhile, cutting off the exhaust main-tube 669 from the first exhaust sub-tube 6691, and connecting the exhaust main-tube 669 to the second exhaust sub-tube 6693;

(2) blowing the air into the air main-tube 667 by the air blower 664, wherein the air passes through the air communicating tube 6672, the first air sub-tube 6671, the first air wrap-tube 6674 and the first air inputting sub-tube 627 in sequence for entering the first heat storing chamber 626; heating the air with the first heat storing body 623 before the air enters the first combustor 621; meanwhile, blowing the clean coal gas obtained by purifying and recycling the raw gas into the coal gas main-tube 668 by the coal gas blower 665, wherein the coal gas passes through the coal gas communicating tube 6682, the first coal gas sub-tube 6681, the first coal gas wrap-tube 6684 and the first coal gas inputting sub-tube 622 in sequence for entering the first combustor 621 to burn; wherein because the exhaust main-tube 669 is cut off from the first exhaust sub-tube 6691, and correspondingly, the exhaust main-tube 669 communicates with the second exhaust sub-tube 6693, exhaust generated by burning the coal gas in the first combustor 621 is only able to enter the second combustor 601 through the combustor through-hole 6251 at the top of the external flame path isolating wall 625, and then be cooled by the second heat storing body 603 of the second heat storing chamber 606 before being outputted by the exhaust blower 666 through the second exhaust outputting sub-tube 608, the second exhaust wrap-tube 6695, the second exhaust sub-tube 6693 and the exhaust main-tube 669;

(3) after burning for a while, driving the upper disk 661 to reversely rotate on the lower disk 662 by the rotation reversing motor 663 of the gas reversing device 66, cutting off the air main-tube 667 from the first air sub-tube 6671, and connecting the air main-tube 667 to the second air sub-tube 6673; meanwhile, cutting off the coal gas main-tube 668 from the first coal gas sub-tube 6681, and connecting the coal gas main-tube 668 to the second coal gas sub-tube 6683; meanwhile, connecting the exhaust main-tube 669 to the first exhaust sub-tube 6691, and cutting off the exhaust main-tube 669 from the second exhaust sub-tube 6693; and (4) blowing the air into the air main-tube 667 by the air blower 664, wherein the air passes through the air communicating tube 6672, the second air sub-tube 6673, the second air wrap-tube 6675 and the second air inputting sub-tube 607 in sequence for entering the second heat storing chamber 606; heating the air with the second heat storing body 603 of the second heat storing chamber 606 before the air enters the second combustor 601; meanwhile, blowing the clean coal gas obtained by purifying and recycling the raw gas into the coal gas main-tube 668 by the coal gas blower 665, wherein the coal gas passes through the coal gas communicating tube 6682, the second coal gas sub-tube 6683, the second coal gas wrap-tube 6685 and the second coal gas inputting sub-tube 602 for entering the second combustor 601 to burn; wherein because the exhaust main-tube 669 communicates with the first exhaust sub-tube 6691, and correspondingly, the exhaust main-tube 669 is cut off from the second exhaust sub-tube 6693, exhaust generated by burning the coal gas in the second combustor 601 is only able to enter the first combustor 621 through the combustor through-hole 6251 at the top of the external flame path isolating wall 625, and then be cooled by the first heat storing body 623 of the first heat storing chamber 626 before being outputted by the exhaust blower 666 through the first exhaust outputting sub-tube 628, the first exhaust wrap-tube 6694, the first exhaust sub-tube 6691 and the exhaust main-tube 669.

Therefore, the combustion principle of the external gas heating device 64 is that: when the waste gas in the first combustor 621 produced by coal gas combustion enters into the second combustor 601 via the combustor through-hole 6251, the residual heat of the waste gas is absorbed and cooled via the second combustor 601 and the second heat storing body 603 in the second heat storing chamber 606 for being outputted.

Contrarily, when the waste gas in the second combustor 601 produced by coal gas combustion enters into the first combustor 621 via the combustor through-hole 6251, the residual heat of the waste gas is absorbed and cooled via the first combustor 621 and the first heat storing body 623 in the first heat storing chamber 626 for being outputted.

All in all, by the working mode that the gas in the gas reversing device is inputted twice and outputted once, and the working mode that the storing heat exchanger stores and exchanges the heat, the alternating combustion of two sets of gas heaters is achieved; that is to say, that the gas reversing device sends the air and clean gas into the combustor of the first gas heater 62 for combustion, simultaneously, absorbs the combusted hot waste gas from the combustor of the second gas heater 60, the hot waste gas becomes the low temperature waste gas with a relatively low temperature by the heat absorption and temperature reducing via the second heat storing body 603 in the second storing heat exchanger 604 of the second gas heater 60 to be outputted; similarly, the gas reversing device sends the air and clean gas into the combustor of the second gas heater 60 for combustion, simultaneously, absorbs the combusted hot waste gas from the combustor of the first gas heater 62, the hot waste gas becomes the low temperature waste gas with a relatively low temperature by the heat absorption and temperature reducing via the first heat storing body 623 in the first storing heat exchanger 624 of the first gas heater 62 to be outputted. The method mentioned above uses the residual heat of the waste gas after gas combustion with each other to heat the air, which not only sufficiently utilizes the residual heat of the waste gas after gas combustion to improve the combustion efficiency of the gas in the combustor, but reduces the temperature of the waste gas after gas combustion to some extent, no foreign energy is consumed, thus energy saving and consumption reduction is achieved and coking cost is decreased.

Referring to FIGS. 6 and 15, the internal burning heating device 67 comprises a plurality of sets (three sets are embodied in this example) of third gas heaters 68, fourth gas heaters 69 and coke quenching exhaust heaters 63 which have same structures.

Figure 8:
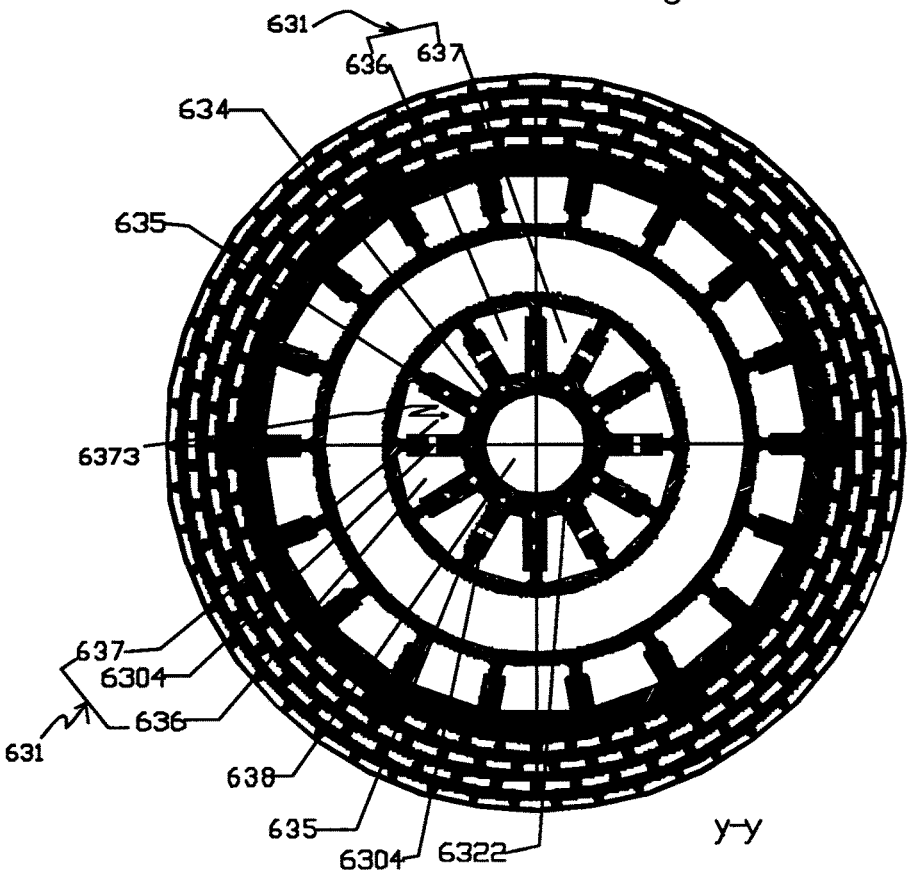
FIG. 8 is a sectional view of y-y in FIG. 11.
Figure 11:
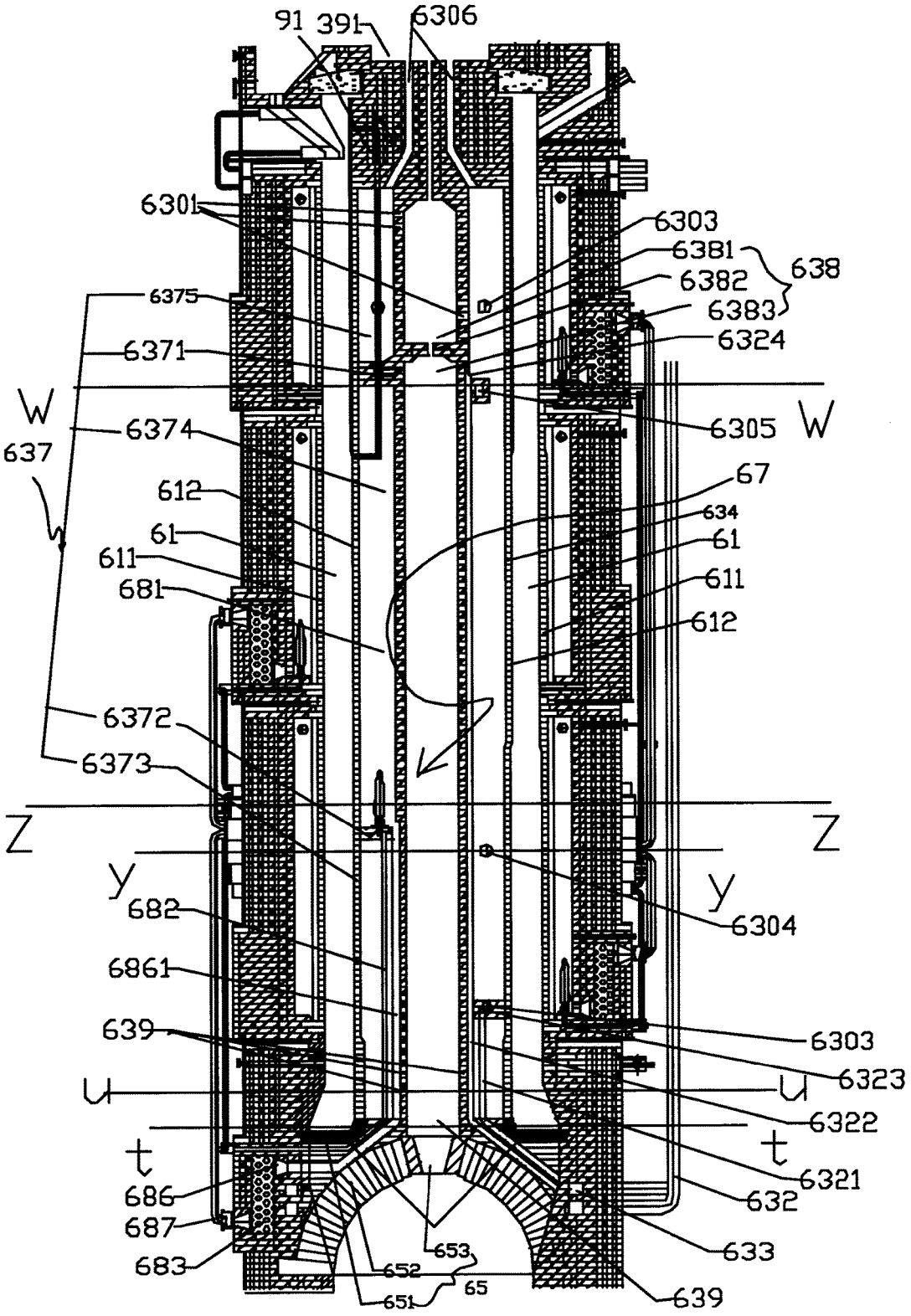
FIG. 11 is a sketch view of installation of a coal pyrolyzing and carbonizing device of the present invention (which is also an enlarged view of E in FIG. 15).

Referring to FIGS. 11 and 8, the coke quenching exhaust heater 63 comprises an internal flame path 631, an air supplement tube 632, a first air supply tube 6321, a second air supply tube 6322, an air supply annular path 633, a central annular wall 634, an internal flame path isolating wall 635, a central path 638, wherein the internal flame path 631 is provided on the flame path bow 65.

As show in FIG. 8, the internal flame path 631 is divided into at least one set of coordinate internal main flame path 636 and internal sub flame path 637 by the internal loop wall 612 of the carbonizing room, the central annular wall 634 located within the internal loop wall 612 of the carbonizing room and at least one internal flame path isolating wall 635. Referring to FIG. 8, in this example, six internal main flame paths 636 and six internal sub flame paths 637 coordinately form six internal flame paths 631.

As shown in FIG. 11, an upper plugging separating plate 6371 and a lower plugging separating plate 6372 are located within the internal sub flame path 637 to divide the internal sub flame paths 637 into an upper section, a middle section and a lower section, namely, an upper internal sub flame path section 6375, a middle internal sub flame path section 6374 and a lower internal sub flame path section 6373; a waste gas communicating hole 6303 is provided on the internal flame path isolating wall 635 between the upper internal sub flame path section 6375 and the internal main flame path 636, a hot waste gas outputting path 6306 is provided at a top portion of the upper internal sub flame path section 6375 and the internal main flame path 636, the hot waste gas outputting path 6306 is communicated with the waste gas room 391 at an upper portion of the furnace body 91.

As shown in FIGS. 11 and 8, a flame path communicating hole 6304 is provided on the internal flame path isolating wall 635 between the lower internal sub flame path section 6373 and the internal main flame path 636 and is close to a lower portion of the lower plugging separating plate 6372. Referring to FIG. 8, six lower internal sub flame path sections 6373 are respectively communicated with the six internal main flame paths 636 via six flame path communicating holes 6304.

As shown in FIG. 11, the central annular wall 634 defines a central path 638, a path separating plate 6382 is located at a position where the central path 638 is level with the upper plugging separating plate 6371 for dividing the central path 638 into an upper portion and a lower portion, namely, the lower portion forms a high-temperature combustible exhaust inputting path 6383, and the upper portion forms a buffer zone 6381.

Figure 9:
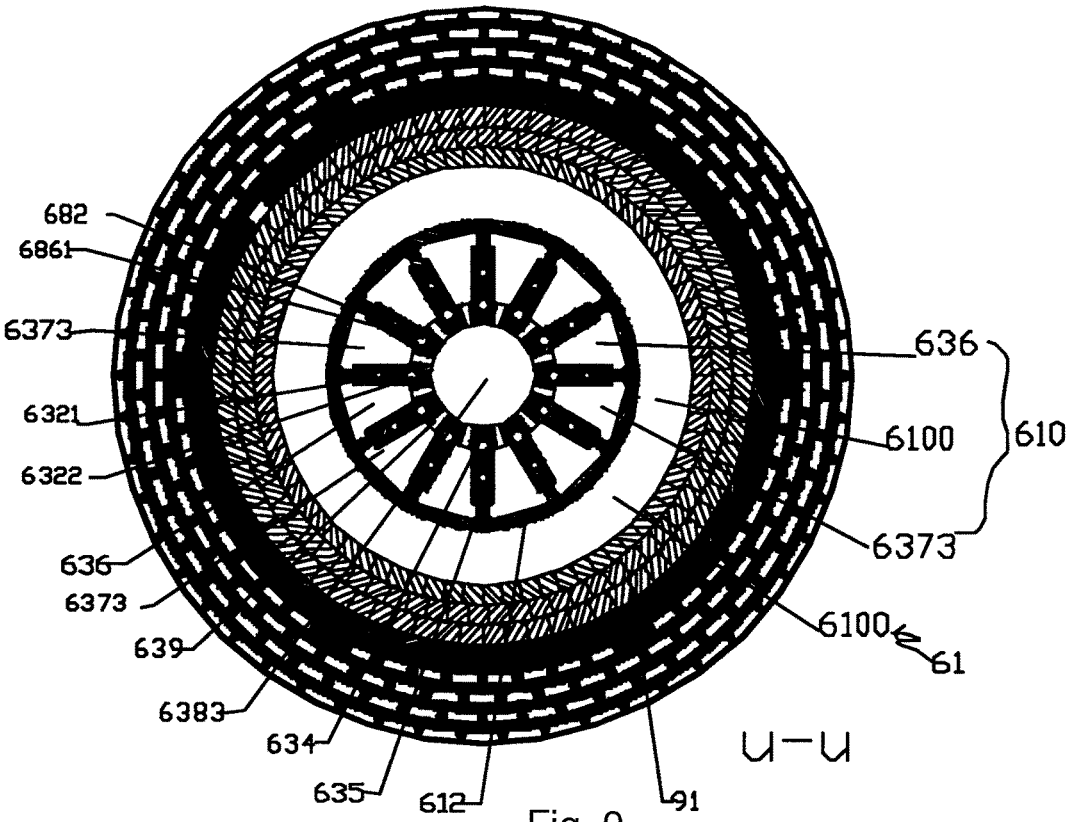
FIG. 9 is a sketch view of a coke modification device of a coal pyrolyzing furnace of the present invention (which is also a sectional view of u-u in FIG. 11).

As shown in FIGS. 9 and 11, a combustible waste gas inputting hole 639 is provided at a lower portion of the central annular wall 634 for communicating the high-temperature combustible exhaust inputting path 6383 with the internal main flame path 636 and the lower internal sub flame path section 6373, and a waste gas inputting hole 6301 is provided at an upper portion of the central annular wall 634 for communicating the buffer zone 6381 with the internal main flame path 636 and the upper internal sub flame path section 6375.

Figure 10:
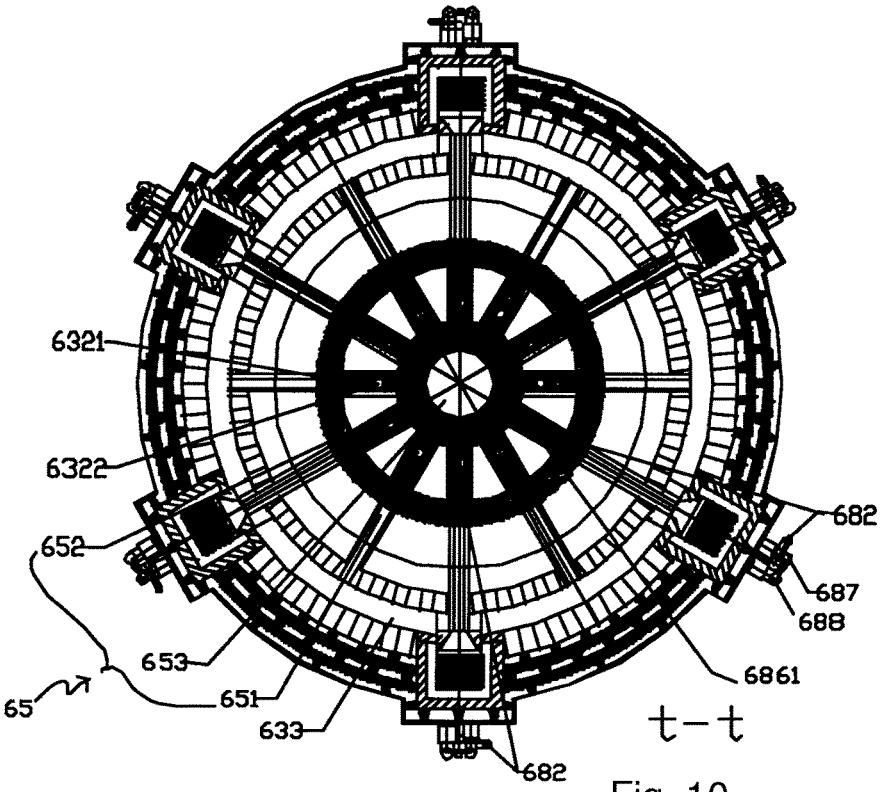
FIG. 10 is a sketch view of a flame path bow of the coal pyrolyzing furnace of the present invention (which is also a sectional view of t-t in FIG. 11).

As shown in FIGS. 11, 10 and 9, the air supply annular path 633 is provided on the furnace body 91, the air supplement tube 632 leads to the air supply annular path 633, the first air supply tube 6321 and the second air supply tube 6322 are communicated with the air supply annular path 633, and pass through under a strip bow 651 of the flame path bow 65 and upwardly extend to an interior of the internal flame path isolating wall 635 between the internal main flame path 636 and the internal sub flame path 637.

As shown in FIGS. 11 and 2, the first air supply tube 6321 is located within the internal flame path isolating wall 635 between the internal main flame path 636 and the internal sub flame path 637, a first air supply exit 6323 of the first air supply tube 6321 is located under the lower plugging separating plate 6372 and leads to the internal main flame path 636 and the lower internal sub flame path section 6373. As shown in FIG. 11, the second air supply tube 6322 is also located within the internal flame path isolating wall 635 between the internal main flame path 636 and the internal sub flame path 637, a second air supply exit 6324 of the second air supply tube 6322 is located at a position which is level with or slightly higher than the upper plugging separating plate 6371 and leads to the internal main flame path 636.

Figure 7:
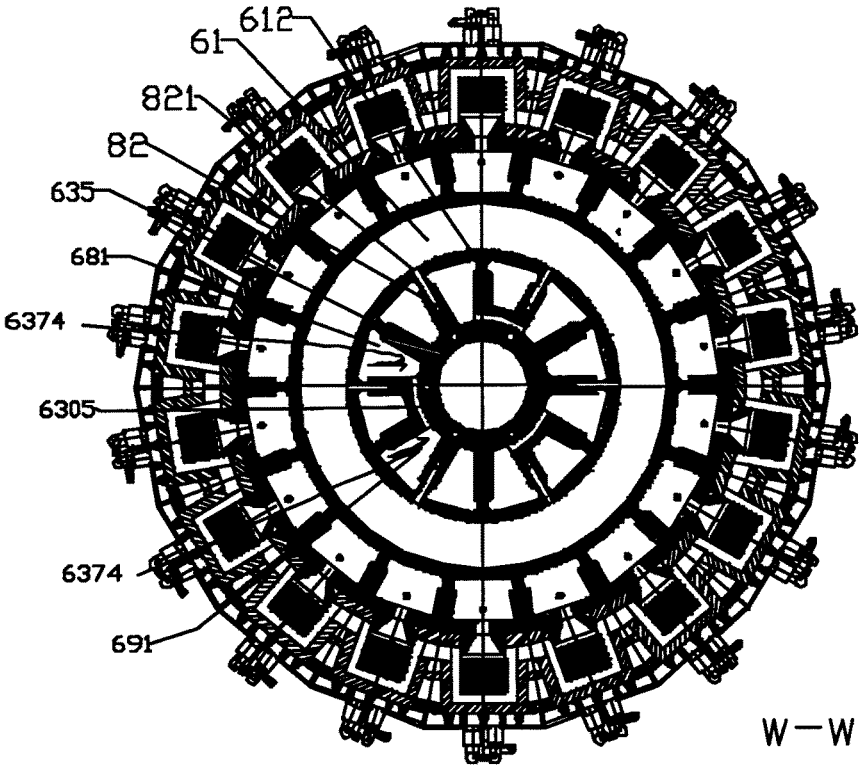
FIG. 7 is a sectional view of w-w in FIG. 11.

As shown in FIGS. 11 and 7, the middle internal sub flame path section 6374 forms a relatively closed independent gas combustor, a previous middle internal sub flame path section 6374 is communicated with an immediately following middle internal sub flame path section 6374 via the combustor path 6305 for defining a related group, the combustor path 6305 is located below the upper plugging separating plate 6371 and passes through the internal main flame path 636 between the previous middle internal sub flame path section 6374 and the immediately following middle internal sub flame path section 6374. Referring to FIG. 7, six middle internal sub flame path sections 6374 are respectively communicated to form three groups via three combustor paths 6305.

As shown in FIGS. 11, 6 and 7, a related set of the third gas heater 68 and the fourth gas heater 69 which has the same structure therewith, are located at two middle internal sub flame path sections 6374 of the internal sub flame path 637 (namely, between the upper plugging separating plate 6371 and the lower plugging separating plate 6372), the structure and combusting principle of the third gas heater 68 and the fourth gas heater 69 are almost identical with those of the first gas heater 62 and the second gas heater 60 mentioned above. The third gas heater 68 comprises the third combustor 681, the third coal gas inputting sub-tube 682, the third heat storing chamber 686, the third heat storing body 683, the third air inputting sub-tube 687 and the third exhaust outputting sub-tube 688.

As shown in FIGS. 11 and 6, it should be noted that the third combustor 681 of the third gas heater 68 is the middle internal sub flame path section 6374, namely, the relatively closed coal gas combustion flame path between the upper plugging separating plate 6371 and the lower plugging separating plate 6372.

As shown in FIGS. 11, 10 and 9, the third coal gas inputting sub-tube 682 passes through under the strip bow 651 of the flame path bow 65 and upwardly extends to the interior of the internal flame path isolating wall 635 for leading to the third combustor 681 (namely, the middle internal sub flame path section 6374), the third heat storing chamber 686 is provided on the furnace body 91 below the strip bow 651, the third heat storing body 683 is located within the third heat storing chamber 686, one end of the third heat storing chamber 686 passes through under the strip bow 651 of the flame path bow 65 via an extending channel 6861, and upwardly extends to the interior of the internal flame path isolating wall 635 for leading to the bottom of the third combustor 681, the other end of the third heat storing chamber 686 is connected with the third air inputting sub-tube 687 and the third exhaust outputting sub-tube 688.

Similarly, the structure of the fourth gas heater 69 is identical with that of the third gas heater 68, it is unnecessary to go into details here. The fourth combustor 691 is communicated with the third combustor 681 via the combustor path 6305 for forming a related group (as shown in FIG. 7).

Referring to FIG. 5-1, the third coal gas inputting sub-tube 682, the third air inputting sub-tube 687 and the third exhaust outputting sub-tube 688 of the third combustor 681 of the third gas heater 68 are respectively communicated with the first coal gas sub-tube 6681, the first air sub-tube 6671 and the first exhaust sub-tube 6691 via the first coal gas wrap-tube 6684, the first air wrap-tube 6674 and the first exhaust wrap-tube 6694.

Referring to FIG. 5-1, the fourth coal gas inputting sub-tube 692, the fourth air inputting sub-tube 697 and the fourth exhaust outputting sub-tube 698 of the fourth combustor 691 of the fourth gas heater 69 are respectively communicated with the second coal gas sub-tube 6683, the second air sub-tube 6673 and the second exhaust sub-tube 6693 via the second coal gas wrap-tube 6685, the second air wrap-tube 6675 and the second exhaust wrap-tube 6695.

All in all, the combustion principle of the third gas heater 68 and the fourth gas heater 69 is almost identical with that of the first gas heater 62 and the second gas heater 60. It is unnecessary to go into details here.

In the present example, the principle of the internal burning heating device 67 is that: the upper internal sub flame path section 6375, the lower internal sub flame path section 6373 and the internal main flame path 636 utilize the high temperature combustible waste gas produced by the dry quenching for air supply combustion heating, and the middle internal sub flame path section 6374 utilizes the clean gas produced by recovering and purifying the crude gas for combustion heating.

In the present example, the working principle of the internal burning heating device 67 is that: (1) when the high temperature combustible waste gas passes through the high temperature combustible waste gas inputting path 6383 below the central path 638, and then enters into the internal main flame path 636 and the lower internal sub flame path section 6373 via the combustible waste gas inputting hole 639, the temperature of the just entered high temperature combustible waste gas is higher and generally in the range of 1000° C.-1100° C., and however, with the working outside and heat dissipation resulted from the rise of the waste gas in the internal main flame path 636 and the lower internal sub flame path section 6373, the temperature will be decreased;

(2) at this time, the air is supplemented to the internal main flame path 636 and the lower internal sub flame path section 6373 via the first air supply tube 6321, so as to allow the high temperature combustible waste gas to obtain the oxygen in the air for combustion, after all, the high temperature combustible gas has a certain amount of the combustible gas, which is not enough to provide the needed heat energy and temperature for the coal pyrolysis of the carbonizing room 61;

(3) therefore, when the waste gas, produced by the first air supply combustion of the high temperature combustible waste gas, in the lower internal sub flame path section 6373, comes to the internal main flame path 636 via the flame path communicating hole 6304, and then mixes with the high temperature combustible gas in the internal main flame path 636 and the combusted waste gas for rising in the internal main flame path 636, during the rising process, the mixed high temperature combustible gas and the combusted waste gas provide the heat energy for the coal pyrolysis in the carbonizing room 61 via the internal loop wall 612 thereof, the working outside is produced, thus the temperature is gradually decreased;

(4) therefore, the air is needed to be supplemented again to the middle-upper portion of the internal main flame path 636 via the second air supply tube 6322, so as to further combust the mixed high temperature combustible gas and the combusted waste gas, which not only provides the needed heat energy and temperature for the coal pyrolysis in the carbonizing room 61, but sufficiently combust the high temperature combustible gas for improving the work efficiency of the combustion of the high temperature combustible gas;

(5) in addition, due to the buffer zone 6381 between the internal main flame path 636 and the upper internal sub flame path section 6375, the waste gas inputting hole 6301 is provided on the central annular wall 634 for communicating the buffer zone 6381 with the internal main flame path 636 and the upper internal sub flame path section 6375, the waste gas communicating hole 6303 is provided on the internal flame path isolating wall 635 between the internal main flame path 636 and the upper internal sub flame path section 6375, every internal main flame path 636 is completely communicated with the upper internal sub flame path section 6375 for completely mixing the waste gas after the second air supply combustion, the waste gas between the internal main flame path 636 and the upper internal sub flame path section 6375 reaches the uniform temperature and pressure for providing the coal pyrolysis of the upper portion of the carbonizing room 61 with the balanced heat energy and temperature;

(6) finally, the waste gas after the second air supply combustion is discharged into the waste gas room 391 on the upper portion of the body of coal pyrolyzing and carbonizing device 91 via the internal main flame path 636 and the hot waste gas discharging path 6306 on the top of the upper internal sub flame path section 6375;

(7) meanwhile, in order to make up for the shortcoming that the combustible gas in the high temperature combustible gas is not enough to provide the needed heat energy and temperature for the coal pyrolysis in the carbonizing room 61, and in order to sufficiently utilize the crude gas produced during the coal pyrolysis, the clean gas after recovering and purifying the crude gas is provided for the third combustor 681 of the third gas heater 68 and the fourth combustor 691 of the fourth gas heater 69 to combust, that is to say, that the heating is supplemented in the middle internal sub flame path section 6374, which not only provides enough heat energy and temperature for the coal pyrolysis in the carbonizing room 61, but improves the utilization ratio of the crude gas, so that the discharge of the crude gas to the atmosphere is reduced to avoid the air pollution and protect the environment.

Section II: Coke Modification

The coke formed by pyrolyzing the coal in the carbonizing room has uneven heating and coke particle size, so preferably, the coke is provided with a certain temperature and time for sufficiently contacting among the cokes to transfer the heat, thus the coke modification device 610 is needed.

As shown in FIGS. 12, 11, 9 and 15, the coke modification device 610 is located on the flame path bow 65 within the furnace body, and comprises a coke modification room 6100 formed by the lower portion of the carbonizing room 61, the lower portion of the internal main flame path 636, the lower internal sub flame path section 6373, the lower portion of the high temperature combustible waste gas inputting path 6383 of the central path 638 encircled by the central annular wall 634, wherein the combustible waste gas inputting hole 639 is provided on the lower portion of the central annular wall 634 for communicating the high temperature combustible waste gas inputting path 6383 with the internal main flame path 636 and the lower internal sub flame path section 6373.

Furthermore, as shown in FIG. 1, a coke modification temperature observing hole 6101 is provided on the external wall of the furnace body 91, a coke modification thermometer 6102 is located within the coke modification temperature observing hole 6101. Referring to FIG. 14, the control center 90 is electrically connected with the coke modification thermometer 6102 for automatically monitoring the coke modification temperature signal of the coke modification thermometer 6102.

The modification method of the coke modification device is described as follows. The exterior of the coke modification device utilizes the external wall of the body of coal pyrolyzing and carbonizing device, made of heat insulation and refractory material, for heat insulation, and in the interior, the high temperature combustible waste gas enters into the lower portion of the internal main flame path 636 and the lower internal sub flame path section 6373 via the combustible waste gas inputting hole 639, the residual heat of the high temperature combustible waste gas itself is used to provide the needed heat energy and temperature for heat insulation, and especially, it is just right for the just entered high temperature combustible waste gas within the temperature range of 1000° C.-1100° C. to make the coke modification, so as to keep the coke in the coke modification room for a certain time for sufficiently contacting among the coke particles and transferring the heat to equalize the coke particle size.

Section III: Flame Path Bow

As shown in FIGS. 11 and 10, the internal loop wall 612 of the carbonizing room and the internal flame path isolating wall 635 and the central annular wall 634 of the internal burning heating device 67 are located within the furnace chamber, so the flame path bow 65 is needed for supporting, simultaneously, the flame path bow 65 also provides the laying of various pipelines for the internal burning heating device 67. Referring to FIGS. 11 and 10, the flame path bow 65 is located within the furnace chamber below the carbonizing room 61, the internal burning heating device 67 and the coke modification device 610, and comprises a plurality of strip bows 651, a flame bow central annular wall 652, and a high temperature combustible waste gas path 653 formed in the center of the flame bow central annular wall 652, wherein one end of the strip bow 651 is fixed to the central annular wall 652, the other end of the strip bow 651 is fixed to the furnace body 91, the strip bows 651 surround the center of the central annular wall 652 and are spacedly radially arranged at a certain angle. In the present example, an amount of the strip bows 651 is 12, and the amount thereof is the same as the total amount of the internal main flame paths 636 and the internal sub flame paths 637 of the internal burning heating device 67.

As shown in FIGS. 11 and 10, an extending channel 6861 of the third coal gas inputting sub-tube 682 and third heat storing body 686 is provided within a wall body of the strip bow 651, the first air supply tube 6321 and the second air supply tube 6322 are provided within a wall body of another adjacent strip bow 651 to convenient for laying the pipelines of the internal burning heating device 67. Six extending channels 6861 of the third coal gas inputting sub-tube 682 and third heat storing body 686 are respectively provided within the wall bodies of six strip bows 651 in parallel; six first air supply tubes 6321 and six second air supply tubes 6322 are respectively provided in parallel within the wall bodies of another six strip bows 651 for orderly arranging various pipelines of the internal burning heating device 67 without interference.

Section IV: Dry Quenching

The modified coke has a higher temperature, generally, within the range of 1000° C.-1100° C. Therefore, the coke at high temperature needs to be cooled to convenient for transportation and storage, thereby a dry quenching device 7 is needed.

Figure 12:
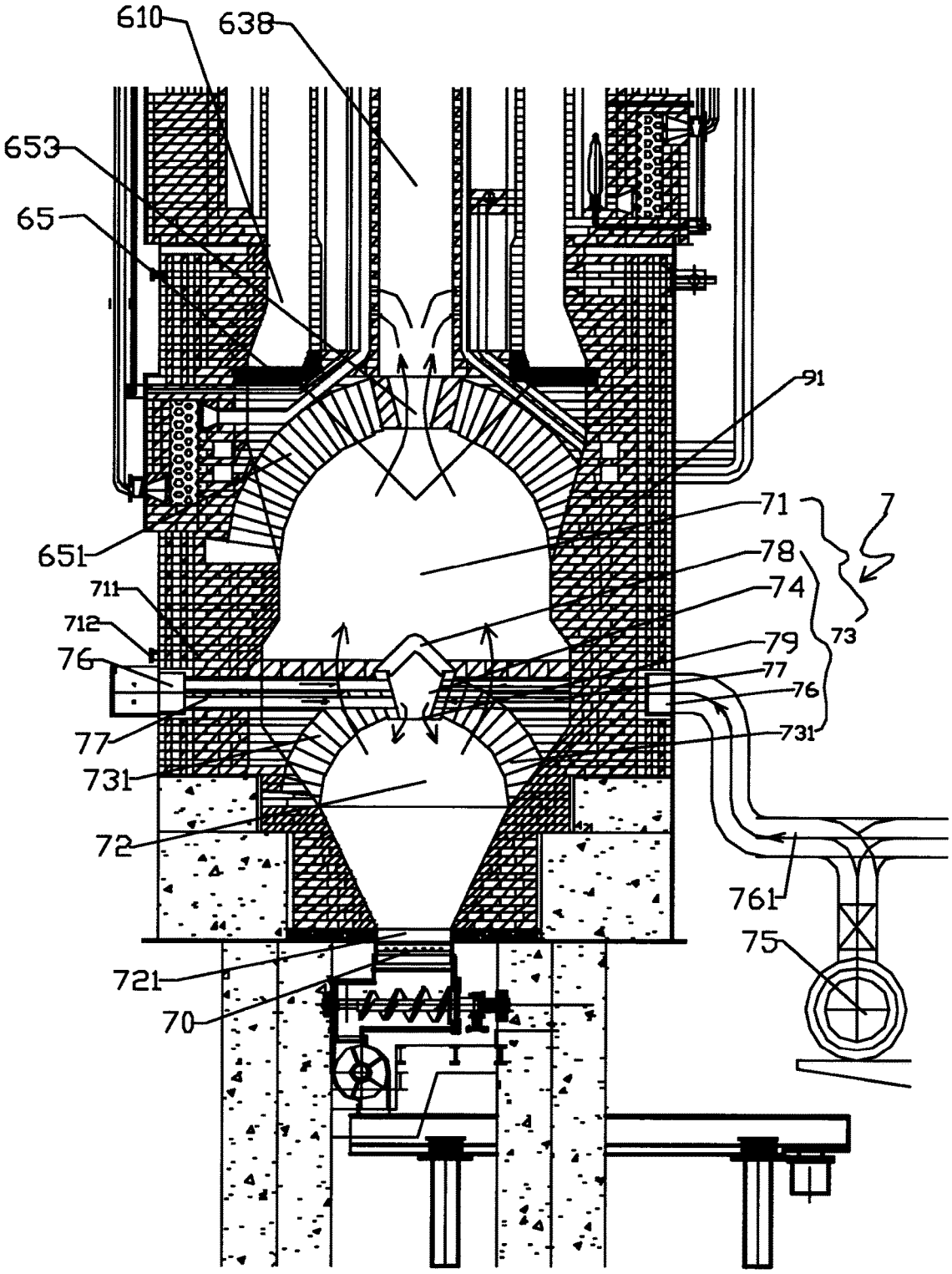
FIG. 12 is a sketch view of a dry quenching device of the coal pyrolyzing furnace of the present invention (which is also an enlarged view of H in FIG. 15).
Figure 13:
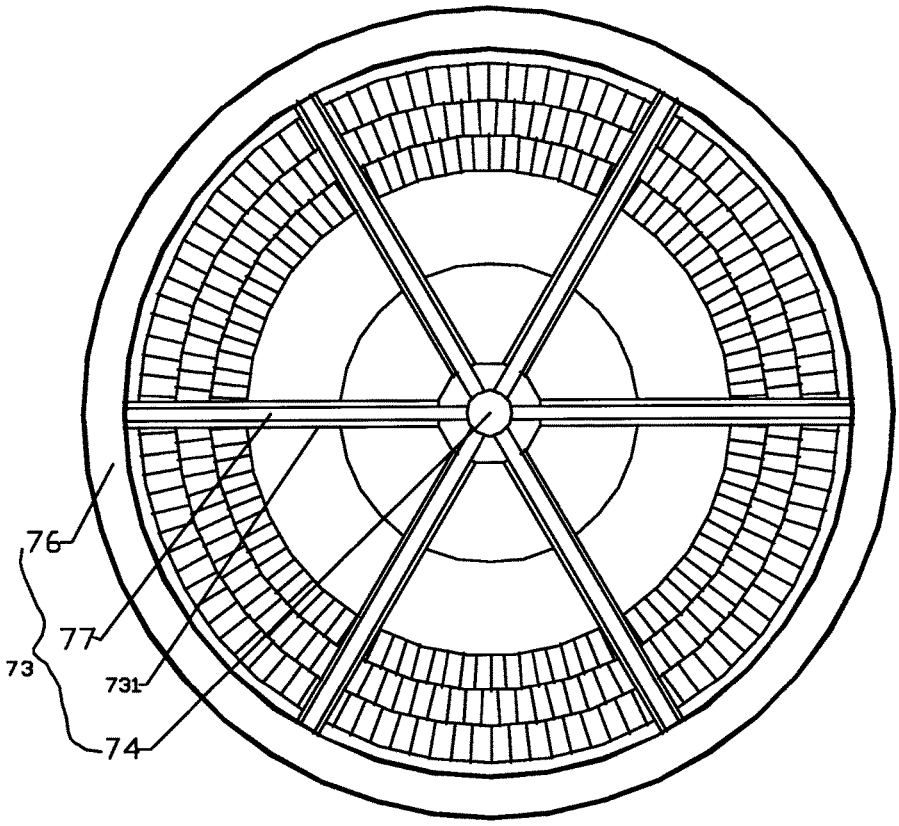
FIG. 13 is a sketch view of a coke quenching bridge bow of the dry quenching device of the coal pyrolyzing furnace of the present invention.

As shown in FIGS. 12 and 13, the dry quenching device 7 is located below the flame path bow 65 and comprises a high temperature coke quenching room 71, a low temperature coke quenching room 72, a coke quenching bridge bow 73 and a coke quenching exhaust blower 75; the high temperature coke quenching room 71 is provided below the flame path bow 65, a top portion of the high temperature coke quenching room 71 is communicated with the high temperature combustible waste gas path 653; the coke quenching bridge bow 73 is located between the and high temperature coke quenching room 71 and the low temperature coke quenching room 72 and comprises a bridge bow 731, a wind collecting room 74, a dry quenching wind annular path 76 and a dry quenching wind tube 77; six bridge bows are spacedly radially arranged within the quenching wind annular path 76 at a certain degree from an axial center of the high temperature coke quenching room 71 and the low temperature coke quenching room 72, a middle of the bridge bow 731 forms the wind collecting room 74 having an inversed conical shape with an upper large diameter and a lower small diameter, a semi-spherical air cap 78 is located at a top of the wind collecting room 74, an opening 79 at the lower portion of the wind collecting room 74 faces to the low temperature coke quenching room 72; the dry quenching wind tube 77 is located within the bridge bow 731, one end of the dry quenching wind tube 77 leads to the wind collecting room 74, the other end of the dry quenching wind tube 77 leads to the dry quenching wind annular path 76, the dry quenching wind annular path 76 is connected with the coke quenching exhaust blower 75 via a wind inputting tube 761; a coking valve 70 is located at a bottom opening 721 of the low temperature coke quenching room 72.

As shown in FIG. 12, the coke quenching temperature observing hole 711 leading to the high temperature coke quenching room 71 is provided at the external wall of the furnace body 91, and the coke quenching thermometer 712 is located within the coke quenching temperature observing hole.

As shown in FIG. 14, the coke quenching thermometer 712, the coke quenching exhaust blower 75 and the coking valve 70 are electrically connected with the control center 90. The control center 90 automatically controls the coke quenching exhaust blower 75 and the coking valve 70, and monitors the coke quenching temperature via the coke quenching thermometer 712. The coke quenching thermometer 712, the coke quenching exhaust blower 75 and the coking valve 70 are electrically connected with the control center 90 via the coke quenching device controller 907. Of course, seen from the electrical control principle, the coke quenching device controller 907 is not the limit to the protection scope of the present example.

The method of dry quenching using the low temperature combustion waste gas in the dry quenching device 7 is described as follows.

(1) The waste gas produced by coal gas combustion in the first gas heater 62 of the external gas heating device 64, the gas heater 60, the third gas heater 68 of the internal gas heating device 67, and the fourth gas heater 69 is introduced into the coke quenching exhaust blower 75. The waste gas produced by coal gas combustion naturally turns to the low temperature waste gas with relatively lower temperature after being absorbed the heat via the heat storing body;

(2) The low temperature waste gas passes through the wind inputting tube 761, the dry quenching wind annular path 76 and the dry quenching wind tube 77 in sequence to the wind collecting room 74 via the coke quenching exhaust blower 75, the low temperature waste gas gathers in the wind collecting room 74. The wind collecting room 74 adopts the special structure, the air cap 78 on the top thereof is semi-spherical, the middle chamber of the wind collecting room 74 has the inversed conical structure, so the low temperature waste gas is blown out from the bottom opening 79 to the low temperature coke quenching room 72, and then to the high temperature coke quenching room 71 for reducing the temperature of the coke in the high temperature coke quenching room 71 and the coke falling from the high temperature coke quenching room 71 to the low temperature coke quenching room 72. In this example, the temperature of the coke is decreased by air cooling, which is called as dry quenching;

(3) Furthermore, during the dry quenching, the dry quenching device 7 is capable of producing a certain amount of high temperature combustible gas, and the reason is that: firstly, the low temperature waste gas containing a small amount of water makes the chemical reaction while encountering the modified high temperature coke to produce some combustible gases; secondly, partial insufficiently combustion combustible gases exist in the low temperature waste gas itself; thirdly, partial combustible gases exist in the modified high temperature coke itself, these combustible gases move upwardly to the high temperature combustible exhaust path 653 in the middle of the flame bow central annular wall 652, so as to provide the gas source for the internal main flame path 636 and the internal sub flame path 637 of the internal burning heating device 67 of the coal pyrolyzing furnace.

In this example, the low temperature waste gas is produced as follows. The crude gas produced by the coal pyrolyzing is recycled and purified to the clean gas, and then the clean gas passes through the external gas heating device of the coal pyrolyzing furnace and the gas heater of the internal gas heating device for combustion, so that the waste gas is produced, the waste gas turns to the low temperature waste gas by the heat absorption and temperature decrease via the heat storing body of the heat storing chamber. The advantages of the dry quenching device of the present invention are that: the noncombustible combustion waste gas is used to make the dry quenching instead of the existing $N_2$, the equipment is simple, the cost is low, and the economic effect is significant. Compared with the conventional wet coke quenching, the present invention avoids discharging large amount of water coal gas result from a large amount of water encountering the high temperature coke to atmosphere, has less air pollution and water saving, and is capable of sufficiently utilizing the crude gas during the coal pyrolyzing process.

Section V: Continuous Quenching Device

All in all, a big advantage of the coal pyrolyzing furnace of the present invention is continuous quenching instead of conventional intermittent quenching or soil quenching. Compared with the conventional quenching methods, the present invention has incomparable advantages.

What is claimed is:

1. An internal combustion heating device of a coal pyrolyzing furnace, arranged in an internal loop wall of a carbonizing room above a flame path bow, comprising: a coke quenching exhaust heater and at least one set of a first gas heater and a second gas heater with equal structures and associated with each other; wherein said coke quenching exhaust heater comprises an internal flame path, an air supplement tube, a first air supply tube, a second air supply tube, an air supply annular path, a central annular wall, an internal flame path isolating wall and a central path, wherein said internal flame path is divided into at least one set of an internal main flame path and an internal sub flame path in parallel by said internal loop wall of said carbonizing room, said central annular wall inside said internal loop wall of said carbonizing room and at least one said internal flame path isolating wall; an upper plugging separating plate and a lower plugging separating plate are provided in said internal sub flame path and divide said internal sub flame path into an upper section, a middle section and a lower section, which forms an upper internal sub flame path section, a middle internal sub flame path section and a lower inter sub flame path section; a waste gas communicating hole is drilled on a flame path isolating wall between said upper internal sub flame path section and said internal main flame path, a hot waste gas outputting path is provided at a top portion of said upper internal sub flame path section and said internal main flame path, and a flame path communicating hole is drilled on a flame path isolating wall between said lower internal sub flame path section and said internal main flame path; said central path is formed by said central annular wall, a path separating plate is provided at a part of said central path which is abreast of said upper plugging separating plate for dividing said central path into an upper portion and a lower portion, in such a manner that said upper portion forms a buffer zone and said lower portion forms a high-temperature combustible exhaust inputting path; a waste gas inputting hole is drilled on an upper portion of said central annular wall and passes through said buffer zone, said internal main flame path and said upper internal sub flame path section; a combustible waste gas inputting hole is drilled at a lower portion of said central annular wall and passes through said high-temperature combustible exhaust inputting path, said internal main flame path and said lower internal sub flame path section; said air supply annular path is provided on an external wall of a furnace body and communicates with said air supplement tube as well as said first air supply tube and said second air supply tube; said first air supply tube and said second air supply tube pass below a strip bow of said flame path bow and extend upwards for being inside said flame path isolating wall between said internal main flame path and said lower internal sub flame path section; an opening of said first air supply tube is arranged under said lower plugging separating plate and respectively connected to said internal main flame path and said lower internal sub flame path section; an opening of said second air supply tube is connected to said internal main flame path; said middle internal sub flame path section forms a relative-closed independent gas combustor; adjacent middle internal sub flame path sections communicate with each other through a combustor path and forms a cooperating set, said combustor path is under said upper plugging separating plate and passes through said internal main flame path between said adjacent middle internal sub flame path sections; said first gas heater comprises a first combustor, a first coal gas inputting sub-tube, a first heat storing chamber, a first heat storing body, a first air inputting sub-tube and a first exhaust outputting sub-tube, wherein said first combustor is formed by said middle internal sub flame path section, said first coal gas inputting sub-tube passes below said strip bow of said flame path bow and extends upwards for being connected to said first combustor by passing through said flame path isolating wall which is formed by said middle internal sub flame path section; said first heat storing chamber is arranged on said furnace body under said strip bow, and said first heat storing body is arranged inside said first heat storing chamber; a first end of said first heat storing chamber passes below said strip bow of said flame path bow through an extending path and extends upwards for being connected to a bottom of said first combustor by passing through said flame path isolating wall, a second end of said first heat storing chamber is respectively connected to said first air inputting sub-tube and said exhaust outputting sub-tube; similarly, said second gas heater equals to said first gas heater in structures, wherein a second combustor cooperates with said first combustor through said combustor path.

2. The internal combustion heating device, as recited in claim 1, wherein said flame path communicating hole is provided close to a lower portion of said lower plugging separating plate.

3. The internal combustion heating device, as recited in claim 1, wherein said hot waste gas outputting path is communicated with a waste gas room at an upper portion of said furnace body.

4. The internal combustion heating device, as recited in claim 1, wherein said opening of said second air supply tube is located at a position which is level with or slightly higher than said upper plugging separating plate.

* * * * *